US006629591B1

(12) United States Patent
Griswold et al.

(10) Patent No.: US 6,629,591 B1
(45) Date of Patent: Oct. 7, 2003

(54) SMART TOKEN

(75) Inventors: Chauncey Warner Griswold, Reno, NV (US); Joseph R. Hedrick, Reno, NV (US)

(73) Assignee: IGT, Reno, NV (US)

( * ) Notice: Subject to any disclaimer, the term of this patent is extended or adjusted under 35 U.S.C. 154(b) by 209 days.

(21) Appl. No.: 09/759,712

(22) Filed: Jan. 12, 2001

(51) Int. Cl.[7] ..... G07F 7/00; G07F 1/06
(52) U.S. Cl. ..... 194/205; 194/214; 463/25
(58) Field of Search ..... 235/380, 375, 235/379; 463/25; 194/240, 239, 205, 214

(56) References Cited

U.S. PATENT DOCUMENTS

| | | | | | |
|---|---|---|---|---|---|
| 4,926,996 | A | * | 5/1990 | Eglise et al. | 194/205 |
| 5,056,141 | A | | 10/1991 | Dyke | |
| 5,166,502 | A | | 11/1992 | Rendleman et al. | 235/492 |
| 5,326,104 | A | | 7/1994 | Pease et al. | |
| 5,498,859 | A | * | 3/1996 | Farmont | 194/214 |
| 5,505,449 | A | | 4/1996 | Eberhardt et al. | |
| 5,651,548 | A | | 7/1997 | French et al. | 273/309 |
| 5,706,925 | A | * | 1/1998 | Orus et al. | 194/214 |
| 5,735,742 | A | | 4/1998 | French | 463/25 |
| 5,764,789 | A | | 6/1998 | Pare, Jr. et al. | |
| 5,855,515 | A | | 1/1999 | Pease et al. | 463/27 |
| 5,892,210 | A | | 4/1999 | Levasseur | 235/380 |
| 5,895,321 | A | * | 4/1999 | Gassies et al. | 273/148 R |
| 5,902,983 | A | | 5/1999 | Crevelt et al. | |
| 6,003,651 | A | | 12/1999 | Waller et al. | 194/202 |
| 6,021,949 | A | * | 2/2000 | Boiron | 235/487 |
| 6,048,269 | A | | 4/2000 | Burns et al. | |
| 6,050,895 | A | | 4/2000 | Luciano, Jr. et al. | 463/7 |
| 6,062,981 | A | | 5/2000 | Luciano, Jr. | 463/26 |
| 6,099,408 | A | | 8/2000 | Schneier et al. | |
| 6,109,530 | A | | 8/2000 | Larson et al. | 235/492 |
| 6,148,094 | A | | 11/2000 | Kinsella | |
| 6,186,895 | B1 | | 2/2001 | Oliver | 463/25 |
| 6,193,153 | B1 | | 2/2001 | Lambert | |
| 6,264,109 | B1 | * | 7/2001 | Chapet et al. | 235/487 |
| 6,296,190 | B1 | * | 10/2001 | Rendleman | 235/487 |
| 6,330,162 | B2 | * | 12/2001 | Sakamoto et al. | 174/52.3 |

FOREIGN PATENT DOCUMENTS

| | | | | |
|---|---|---|---|---|
| EP | 0360613 A2 | * | 9/1989 | G07F/17/34 |
| WO | WO 99/19027 | | 4/1999 | |

OTHER PUBLICATIONS

Cagliostro, Charles, "Primer on Smart Cards," http://www.scia.org/knowledgebase/aboutSmartCards/primer.htm Jul. 2000.

Francher, Carol H., "Smart Cards," *Scientific American*, Aug. 1996.

Gorman, Trisha, "Smart Cards Come to the Web—Are You Ready?" *NetscapeWorld*, Mar. 1997.

* cited by examiner

*Primary Examiner*—Donald P. Walsh
*Assistant Examiner*—Mark J Beauchaine
(74) *Attorney, Agent, or Firm*—Marshall, Gerstein & Borun

(57) ABSTRACT

A token for use in a cashless transaction involving an electronic device includes a token body having a coin shape. The token has a digital circuit embedded within the token body and a memory embedded within the token body that is coupled to the digital circuit. The token also includes an input/output interface embedded within the token body that is coupled to the digital circuit and which enables the digital circuit to communicate with the electronic device.

19 Claims, 4 Drawing Sheets

SMART TOKEN

BACKGROUND OF THE INVENTION

1. Field of the Invention

The invention relates generally to cashless electronic transactions and, more particularly, the invention relates to a coin-shaped smart token for use in conducting cashless transactions with a variety of electronic devices.

2. Description of Related Technology

Smart cards are rapidly becoming a preferred way of efficiently conducting secure cashless electronic transactions. Generally speaking, a smart card is a plastic credit card-shaped device that has a semiconductor-based integrated circuit chip embedded within the plastic body of the card. Typically, the smart card interfaces with a card reader through gold plated contact pads on the surface of the card or by conveying electromagnetic signals through an antenna consisting of several loops of wire or conductive ink embedded within the plastic body of the card. Conventional smart cards typically do not have an on-board power source and, as a result, must derive their power from the card reader. Smart cards requiring direct contact to convey power and communication signals must be inserted by a user into a contact type reader, whereas contactless cards that communicate using electromagnetic signals need only be in close proximity to a reader to receive power from and to communicate with the reader. Additionally, hybrid and "combi" smart cards that can interface with both contact and contactless readers are now beginning to emerge.

As is well known, smart cards are currently made for use in a variety of applications that range from relatively simple, low security applications such as pre-paid phone cards to highly complex, high security applications such as personal banking and investment management. A relatively simple and low cost memory-type integrated circuit semiconductor chip is often specified for use in low complexity smart card applications, whereas a higher complexity and higher cost processor-type chip is specified for use in high complexity smart card applications. Memory-type chips are relatively simple devices that include an on-board memory and access logic, which enables a smart card reader to retrieve some or all of the information stored within the on-board memory. These memory-type chips typically provide only basic security measures, if any, and usually rely on the card reader to perform important or more complex security or access control functions.

On the other hand, processor-type chips, in addition to an on-board memory and memory access logic, also include a microprocessor that can execute programs stored within the on-board memory. As a result, smart cards having a processor-type chip can typically store more data and perform complex security functions such as, for example, data encryption, personal identification number (PIN) verification, comparison of stored biometric data (e.g., voiceprints, fingerprints, retinal characteristics, dynamic signature characteristics, etc.) to the current smart card user's characteristics, etc.

While smart cards are now widely used in phone card and credit card applications, smart cards have not been widely accepted for use in some types of cashless transaction applications. For example, casino gaming devices do not typically accept smart cards. However, many gaming devices are configured to accept player tracking cards, which are plastic credit card-shaped devices that have a magnetic stripe encoded with the authorized card holder's identification information. Player tracking cards track the games played, the amount of time each game is played, the bets placed at each game by the card holder, etc. Unfortunately, player tracking cards do not have any stored monetary value and, thus, do not enable players to conduct cashless transactions within a casino environment.

In any event, while smart cards have proven to be a secure method of conducting cashless transactions with a variety of electronic devices such as vending machines, toll/fare collection devices for mass transits systems, etc., there are several drawbacks to the plastic credit card-shaped form of conventional smart cards. For example, plastic credit card-shaped smart cards can be easily folded or cracked, which can render the card unusable and which can jam a card reader if the damaged card is inserted in the card reader by a determined user. Further, conventional credit card-shaped smart cards do not provide any tactile or visual feedback (other than textual information printed on the face of the card) that the card carries monetary value, nor do these cards provide any indication of the monetary value remaining on the card. Still further, conventional smart cards do not provide any distinctive audible feedback that a card has been returned to the user. In other words, when a card reader ejects a conventional smart card there is no distinctive sound (other than a monotonic beeping, for example) similar to the distinctive "clinking" noise made when change or unspent tokens are ejected into a coin return tray. Still further, conventional smart cards are virtually indistinguishable from the many other types of credit card-shaped cards (e.g., phone cards, a driver's license, an employer's identification badge, etc.) that a person typically carries, which may be a significant disadvantage in those situations where the user needs to quickly identify which of the items on their person (i.e., in their pocket, wallet, purse, etc.) contains monetary value.

Still further, the typical card reader for a credit card-shaped smart card is relatively exposed (i.e., is located near the surface of a vending machine, etc.) and, thus, may be particularly vulnerable to vandals and thieves.

SUMMARY OF THE INVENTION

The invention packages smart card technology in the form of a coin-shaped token. While the smart token is described herein as being particularly useful in conducting cashless electronic transactions with gaming devices and systems, the smart token may, more generally, be used to conduct cashless transactions with electronic devices within a variety of other applications. For example, the coin-shaped smart token described herein may be used in connection with video games, vending machines, photocopiers, payphones, fare/toll collection, etc.

In accordance with one aspect of the invention, a token for use in a cashless transaction involving an electronic device includes a token body having a coin shape. The token may also include a digital circuit embedded within the token body, a memory embedded within the token body and coupled to the digital circuit, an input/output interface embedded within the token body and coupled to the digital circuit that enables the digital circuit to communicate with the electronic device and a user interface, and a keypad and/or a display which allows a user to interface with the token.

In accordance with another aspect of the invention, a token for use in a cashless transaction involving an electronic device includes a token body having a coin shape. The token may also include a digital circuit embedded within the token body, as well as a memory coupled to the digital circuit, and an input/output interface including an antenna and a plurality of contacts in the surface of the token that enables the digital circuit to communicate with the electronic device.

In accordance with another aspect of the invention, a method of conducting a cashless transaction for use with a coin-shaped token having a memory and an input/output interface, each embedded within the token, includes using an electronic device to interrogate the token for information stored in the memory, receiving an input from a user and comparing the input to security information stored in the memory, determining whether the cashless transaction can be completed based on the information stored in the memory and updating the information stored in the memory based on the cashless transaction.

In accordance with yet another aspect of the invention, a gaming device for use in a cashless transaction system having a coin-shaped token with a memory, a processor, and an input/output interface, each embedded within the token, includes a computer readable medium and a computer program stored on the computer readable medium and adapted to be executed by the processor. The computer program may be adapted to interrogate the token for information stored in the memory, to interrogate the token based upon input associated with the user, to determine whether the cashless transaction can be completed based on the information stored in the memory and to update the information stored in the memory based on the cashless transaction.

In accordance with still another aspect of the invention, a method of conducting a cashless gaming transaction for use with a gaming device and a coin-shaped token having a memory, a processor, and an input/output interface, each embedded within the token. The method includes using the token in the gaming device, using an electronic device to interrogate the token for information stored in the memory, initiating a gaming session on the gaming device, determining a value payout associated with an outcome of the game, and updating the information stored in the memory based on the value payout.

The invention itself, together with further objectives and attendant advantages, will best be understood by reference to the following detailed description, taken in conjunction with the accompanying drawings and the appended claims.

DETAILED DESCRIPTION OF THE PREFERRED EMBODIMENTS

Generally speaking, the smart token described herein provides smart card technology in the form of a coin-shaped token that may be used to conduct secure electronic cashless transactions. The smart token has a rugged token body, which may, for example, be made of metal or a hard plastic material that cannot be easily folded, bent or cracked as can conventional thin plastic credit card-shaped smart cards. As a result, the smart token described herein cannot be easily physically distorted or damaged in a manner that would be likely to cause a card reader to jam and which would render the smart token unusable. Additionally, the coin-like form of the smart token described herein provides tactile, visual and audible feedback that may facilitate cashless transactions. For example, when a transaction is complete, an electronic device (such as a gaming machine, vending machine, etc.) may eject the smart token in a conventional manner into a coin tray and the smart token may make a distinctive "clinking" noise when it strikes the coin tray, particularly if the smart token is made of a metal or any other hard material. Also, for example, the coin-shaped form of the smart token can be easily and quickly distinguished from the large number and variety of credit card-shaped cards that are typically carried by a person, thereby enabling faster transaction times, which may, for example, be particularly beneficial in a toll/fare application. Additionally, the coin-shaped smart token described herein can travel under its own weight deep inside an electronic transaction device (e.g., a gaming device, vending machine, etc.), which enables a reader device to be placed in a more secure location within the body of the electronic transaction device, thereby minimizing the accessibility of the reader to vandals and thieves.

It is important to recognize that although the smart token is described herein as being particularly useful in conducting cashless transactions with gaming devices and systems, the smart token may, in general, be used to conduct cashless transactions with electronic devices within a variety of other applications. For example, the coin-shaped smart token may be used in connection with video games, vending machines, photocopiers, payphones, fare/toll collection, etc.

Figure 1A:
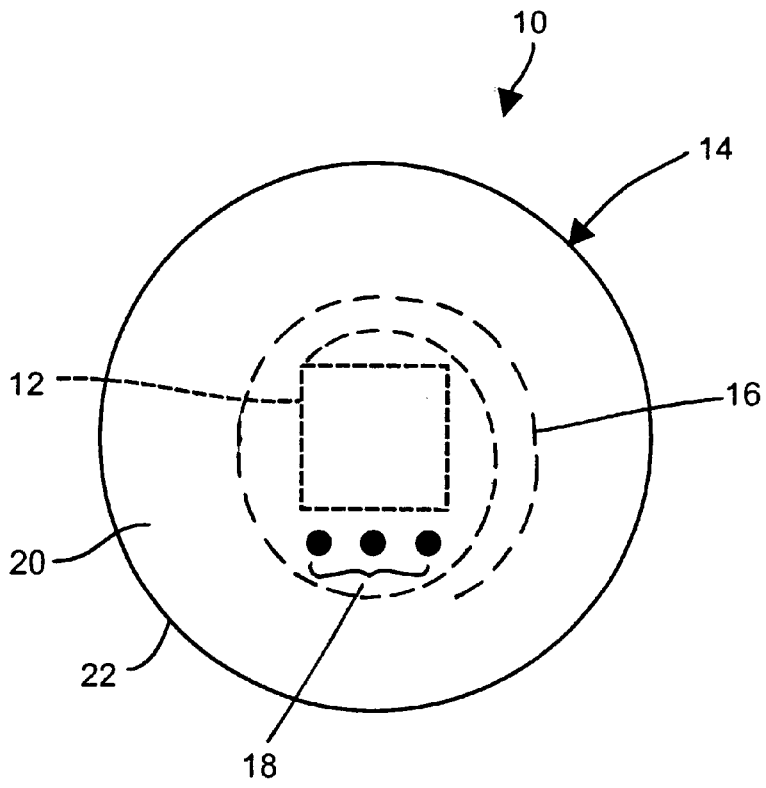
FIG. 1A is a plan view of a smart token according to one aspect of the invention.
Figure 1B:
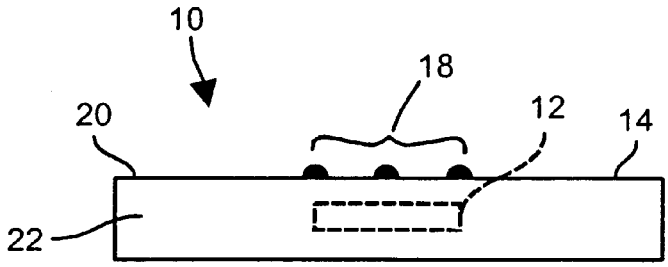
FIG. 1B is front elevational view of the smart token shown in FIG. 1A.

FIGS. 1A and 1B illustrate, by way of example only, a smart token 10 according to one aspect of the invention. The smart token 10 may include a digital circuit 12 that is embedded within a token body 14, an antenna 16 and a plurality of surface contacts 18, which may also be embedded within the token body 14. The token body 14 preferably has a non-rectangular coin shape and is shown by way of example only to have a generally disk-shaped geometry to facilitate the use of the smart token 10 with electronic devices having conventional coin slot openings. While a disk-shaped geometry is depicted in FIGS. 1A and 1B, other geometries may be used without departing from the scope of the invention. For example, the token body 14 may have a generally polygonal geometry.

The token body 14 may be made of a metal and/or a plastic material to suit any desired application. For example, a metal material may be selected for applications in which a high degree of ruggedness is required and/or where a substantial mass is required to enable the smart token 10 to force its way through the internal mechanisms of an electronic transaction device. The internal mechanisms of the electronic transaction device may include various levers, switches, etc. that require the smart token 10 to exert a substantial actuation force. Additionally, a metal material cannot be easily bent or otherwise deformed and provides a highly distinctive audible"clinking" sound when discharged into a coin tray of an electronic transaction device. Still further, a metal material provides a highly distinctive visual and tactile feedback that is intuitively associated with monetary value. Thus, using a metal for at least a portion of the token body 14 may enable a user to quickly distinguish the token from the many non-monetary items which are typically carried.

Alternatively, the token body 14 may be made of a plastic material or a combination of metal and plastic materials. Although a plastic material may not provide the weight, tactile, acoustic, and strength qualities of a metal material, plastic materials may facilitate the integration of the digital circuit 12, the antenna 16 and the surface contacts 18 within the token body 14. For example, an electrically insulating thermoplastic material may be selected so that the token body 14 can be injection molded (using insert molding techniques, for example) to encapsulate the digital circuit 12, the antenna 16 and the surface contacts 18, without requiring any secondary fabrication steps such as gluing, milling, etc. Further, the insulating properties of the plastic material may simplify the manner in which the digital circuit 12, the antenna 16 and the surface contacts 18 are embedded within the token body 14. For instance, the antenna 16 may be directly embedded within a plastic material, whereas with a metal material the antenna 16 must be properly insulated from the metal portions of the token body 14 and must be configured so that the metal portions of the token body 14 do not interfere with reception and transmission of electromagnetic signals. Similarly, the surface contacts 18 must be insulated from any metallic material used in making the token body 14 to prevent shorting between individual ones of the surface contacts 18. Still further, it is important to recognize that the smart token 10 may be made of a variety of other materials such as clay, ceramic, glass, rubber, etc. without departing from the scope and the spirit of the invention.

The digital circuit 12 is embedded securely within the token body 14 and may be completely encapsulated to protect the digital circuit 12 from mechanical damage, moisture and other environmental hazards. For example, the digital circuit 12 may be integrally molded with the material of the token body 14 or may be glued into a well or other mounting area of the token body 14 and encapsulated with an epoxy, a silicone-based sealant and/or any other suitable encapsulation material that provides the desired mounting integrity and environmental resistance characteristics.

The antenna 16 is shown as a loop antenna, which is particularly well suited for receiving and transmitting electromagnetic waves using an inductive coupling mechanism. Generally speaking, the antenna 16 is a part of the input/output (I/O) interface to the digital circuit 12 and may be fabricated using one or more turns of wire that are embedded directly within the token body 14 or, alternatively, the antenna 16 may be fabricated using conductive ink traces that form loops on the surface of the substrate of the digital circuit 12. Still further, the antenna 16 may use another configuration or geometry and/or may use a capacitive rather than an inductive coupling mechanism. In any event, those of ordinary skill in the art will recognize that the desired range, frequency band, power levels, etc. will determine the best antenna configuration for a particular application.

The smart token 10 may alternatively or additionally include the surface contacts 18, which enable a reader within an electronic device to make a conductive electrical connection to the digital circuit 12. Although the surface contacts 18 are shown as being accessible from a face 20 of the token body 14, the surface contacts 18 may, alternatively, be configured to be accessible from an edge 22 of the token body 14. The contacts 18 may be gold plated to provide a high conductivity and a high degree of resistance to corrosion. Of course, other plating materials and surfaces such as bronze, tin, nickel, conductive ink, etc. may be used instead. Additionally, although three contacts are shown, any number of contacts may conceivably be used without departing from the scope of the invention. In some applications it may be desirable to include both the antenna 16 and the surface contacts 18 as part the I/O interface to the digital circuit 12. For example, where a single token type is to be used with both contact-type and contactless reader devices it may be desirable to include both the antenna 16 and the surface contacts 18. On the other hand, if a single type of reader is prevalent or exclusively used in an application, then either the antenna 16 or the surface contacts 18 may be included as a part of the smart token 10.

In applications using the surface contacts 18, alignment of the contacts 18 may be accomplished using any of a variety of techniques. For example, the token body 14 may have an asymmetric geometry, may have a cutout area, or may be shaped in any other manner to provide a mechanical key feature. In this way, the geometry of the token body may enable a mechanical alignment device to sense the absolute orientation of the token body 14 and to perform an alignment of the token body 14 so that a reader may properly contact the surface contacts 18. Alternatively, graphic indicia may be provided on token body 14 to enable an optically-based alignment of the token body 14 and surface contacts 18 with the reader device.

Figure 2:
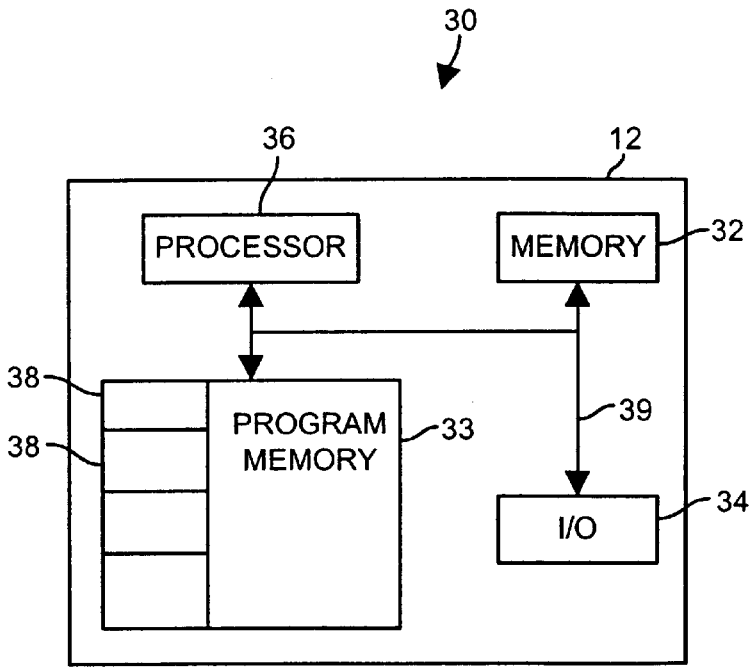
FIG. 2 is an exemplary functional block diagram of a digital circuit that may be used within the smart token shown in FIGS. 1A and 1B.

FIG. 2 is an exemplary functional block diagram 30 of the digital circuit 12 that is used within the smart token 10 shown in FIGS. 1A and 1B. The digital circuit 12 may include a memory 32, a program memory 33, an input/output (I/O) block 34, a processor 36 and a plurality of software routines 38, which may be stored in the program memory 33 and executed by the processor 36 to carry out the methods described herein. The processor 36 may be communicatively coupled to the memory 32, the program memory 33 and the I/O block 34 via an address/data bus 39.

As is well known, conventional smart cards use commercially available smart chips, which are typically integrated circuits that are fabricated using a monolithic semiconductor chip. Although such readily available smart chips may be used to implement the digital circuit 12 described herein, the digital circuit 12 may alternatively be fabricated using a variety of other techniques. For example, multiple integrated circuit semiconductor chips as well as discrete electronic components may be integrated on a common substrate using conventional die-down chip mounting techniques and other hybrid circuit fabrication techniques. Alternatively or additionally, custom integrated circuitry such as application-specific integrated circuits (ASICs) may be used to perform the functions shown in FIG. 2 without departing from the scope of the invention.

The memory 32 may include random access memory (RAM), read-only memory (ROM), electrically erasable and programmable read-only memory (EEPROM), electrically programmable read-only memory (EPROM), or any other type of memory. Non-volatile portions (i.e., EEPROM, EPROM, ROM, etc.) of the memory 32 may contain the routines 38, security information such as passwords, personal identification numbers (PINs), voiceprints, fingerprints, retinal information (or any other biometric information), etc. associated with a particular person, and monetary information such as account balances, spending limitations by account and category, etc. associated with an authorized user.

The I/O block 34 in conjunction with the antenna 16 and/or the surface contacts 18 enables the digital circuit 12 to communicate with an electronic transaction device (not shown). The I/O block 34 may contain amplifiers and level shifters to enable the digital circuit 12 to interface with the electronic transaction device using a particular communication protocol. The I/O block 34 also includes circuitry that enables the processor 36 to send and receive information, which may be stored in the memory 32, to/from the electronic transaction device.

The routines 38 may perform security functions such as user authorization/verification using comparisons of inputs associated with the token user to stored information such as biometrics, PINs, etc. For example, the routines 38 may process inputs received from a fingerprint verification unit 56 (FIG. 3) to verify a user's identity. Additionally, the routines 38 may encrypt communications between the smart token 10 and the electronic transaction device. Further, the routines 38 may perform account management functions such as updating (e.g., crediting, debiting, etc.) one or more accounts of the authorized user, limiting transactions (e.g., monetary amounts that may be added to or removed from accounts), limiting uses of funds from the one or more accounts based on a predetermined valid use for the funds, etc. For example, some accounts may be made inaccessible for gambling transactions. The routines 38 may also perform a variety of communication functions that enable the digital circuit 12 to respond to interrogations by the electronic transaction device. Still further, the routines 38 may perform user interface functions such as displaying account information (e.g., account balances, transaction history, etc.) on a display 52 (FIG. 3) and/or processing inputs from a keypad 54 (FIG. 3) or other user input device, etc.

Although the digital circuit 12 is described by way of example as including the processor 36, a less complex digital circuit 12 having only the memory 32 and the I/O block 34 may be used instead to keep costs low. In the case where the digital circuit 12 does not include a processor, the I/O block 34 provides the necessary logic circuitry to permit a reader within the electronic transaction device to read information from and to write information to the memory 32. Without the processor 36 (or the routines 38), the digital circuit 12 must rely on the electronic transaction device to perform any desired security functions, which may be objectionable in some applications (e.g., personal financial transactions) where the highest levels of security are desired.

Figure 3:
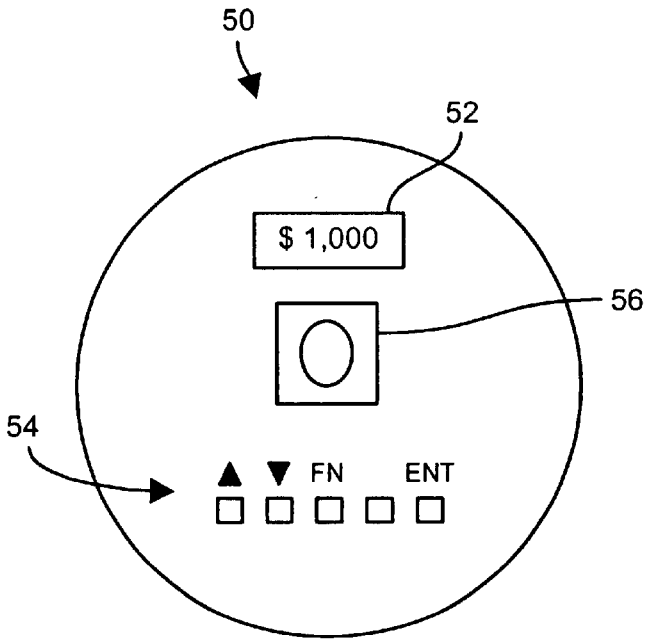
FIG. 3 is a plan view of a smart token according to another aspect of the invention.

FIG. 3 is a plan view of a smart token 50 according to another aspect of the invention. The smart token 50 may use the same components and fabrication techniques to that shown in FIGS. 1A,1B and 2, but additionally includes the display 52, the keypad 54 and the fingerprint verification unit 56. The display 52 may be a low power display, such as, for example, a liquid crystal display (LCD), but may alternatively be any other type of display such as a plasma display, a light-emitting diode (LED) display, etc. The display 52 is configured to display information that is stored in the memory 32 of the digital circuit 12. For example, account balances, historical transaction information, etc. may be displayed.

The keypad 54 may include one or more pushbuttons that enable a user to access the information stored in the memory 32 of the digital circuit 12. For example, the keypad 54 may include increment and decrement keys, which may be used for changing monetary values for cashless transactions or for scrolling thorough accounts and transaction histories. The keypad 54 may additionally include a function key that allows a user to quickly select the desired action. For example, the function key may allow a user to select an account review function, a security function, a security training function that enables a user to train the smart token 50 to the authorized user's voice, fingerprints, retinal characteristics, desired password or personal identification number, etc., and a display mode function that may, for example, enable the authorized user to change the manner in which information is displayed on the display 52. For example, the display may be changed to show monetary values in foreign currencies (i.e., other than dollars), to display textual warnings to the user when one or more account balances reach a predetermined level, to indicate if unauthorized use of the smart token 50 was attempted, etc. Additionally, in embodiments where the smart token 50 includes an antenna (such as the antenna 16 shown in FIG. 1A), information may be transmitted from an electronic transaction device or from some other central transmitting station to the smart token 50 and displayed for viewing by the user of the smart token 50 on the display 52. For example, instructional information, advertisements, logos, personal messages (e.g., "you have a phone call at the front desk"), etc. may be transmitted and displayed to the token user.

The fingerprint verification unit 56 may be, for example, a polymer based sensing device that converts a user's fingerprint into digital information, which can be processed by the processor 36 and one or more of the routines 38 to verify the user's identity. For example, Ethentica Corporation, which may be found at www.Ethentica.com, produces such polymer-based fingerprint verification devices. Practically speaking, many users may prefer the smart token 50 to include a biometric input device, such as the fingerprint verification unit 56, so that their identity can be verified locally using personal verification information which is stored within the token 50, thereby eliminating the need to store relatively sensitive personal verification information in a central location.

Further, the authorized user of the smart token 50 may use the keypad 54 and the display 52 to set various limits (e.g., a spending limit) for one or more accounts, may change security information (e.g., password), may specify other authorized users of the smart token 50, may select which biometric parameters, if any, are to be used in verifying access to the information and the monetary value associated with the smart token 50, and may specify where, when and with what kinds of electronic transaction devices the smart token 50 may be used.

Figure 4:
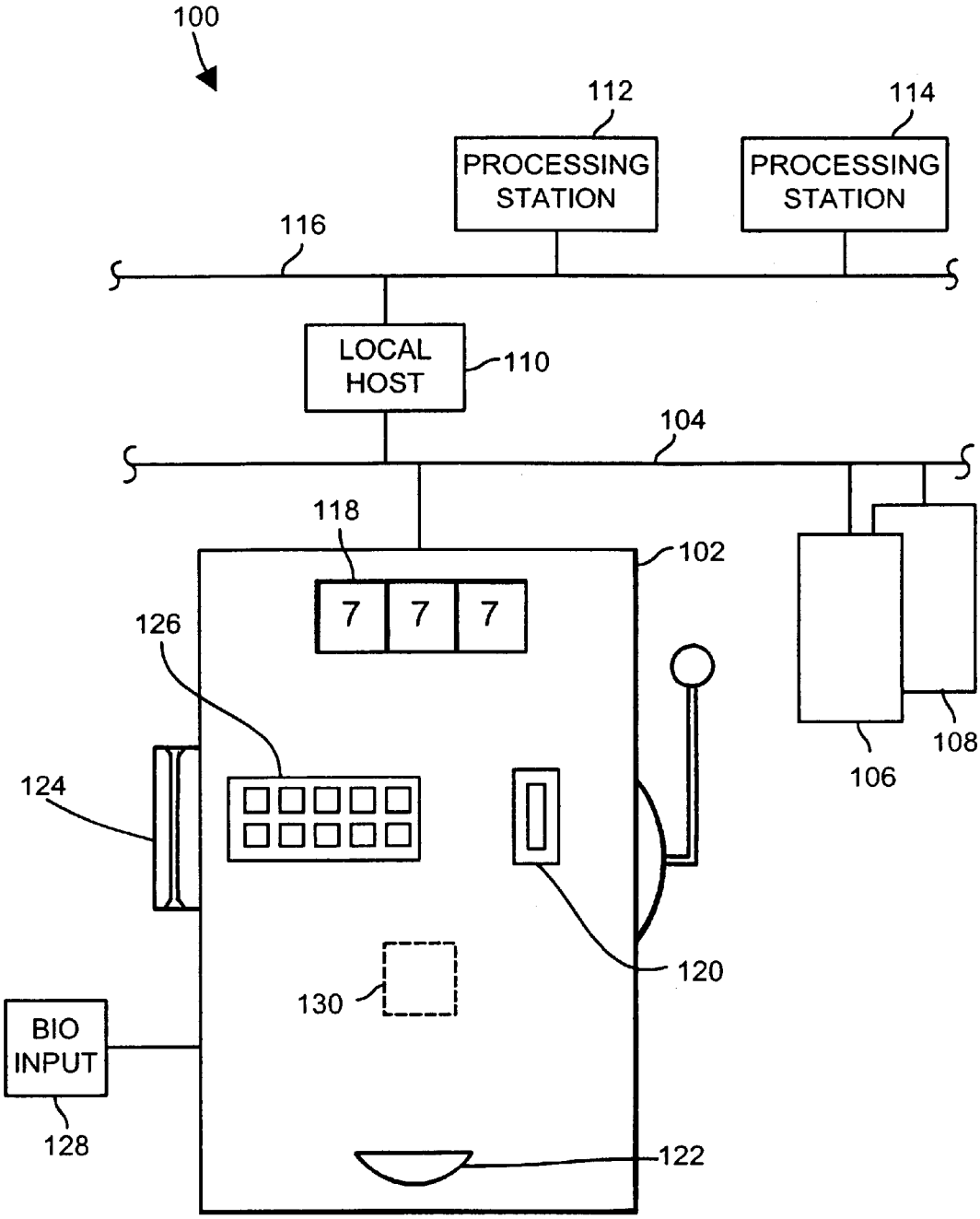
FIG. 4 is an exemplary schematic block diagram of a gaming system within which the smart tokens shown in FIGS. 1A, 1B and 3 may be used to conduct an electronic cashless transaction.

FIG. 4 is an exemplary schematic block diagram of a gaming system 100 within which the smart token 10 of FIGS. 1A and 1B and the smart token 50 of FIG. 3 may be used to conduct a cashless gambling transaction. The gaming system 100 includes a gaming device 102, which is shown by way of example only to be a slot machine and which is communicatively coupled through a local network 104 (e.g., an Ethernet network or any other digital communication network) to additional gaming devices 106 and 108 and to a local host system 110. The host system 110 is further communicatively coupled to system level processing stations 112 and 114 via a system level databus 116. The processing stations 112 and 114 may be workstations or personal computers that perform high level gaming system functions such as security monitoring of the gaming devices 102,106 and 108 connected to the local databus 104, and/or monitoring of transactions and players throughout the gaming system 100. The gaming device 102 may include a display 118, a coin slot 120, a coin tray 122, a conventional magnetic stripe reader 124, a keypad 126, a biometric input device 128, and a reader 130 that can communicate with the smart token described herein. To communicate with the smart token 10, 50, the reader 130 may include conventional smart card reader technology that has been adapted for use within the gaming device 102. Further, when the reader 130 is configured to communicate via the surface contacts 18, the gaming device 102 may include a transport device that mechanically aligns the token body 14 within the reader 130 using a mechanical key feature of the token body 14, graphic indicia, etc.

Figure 5:
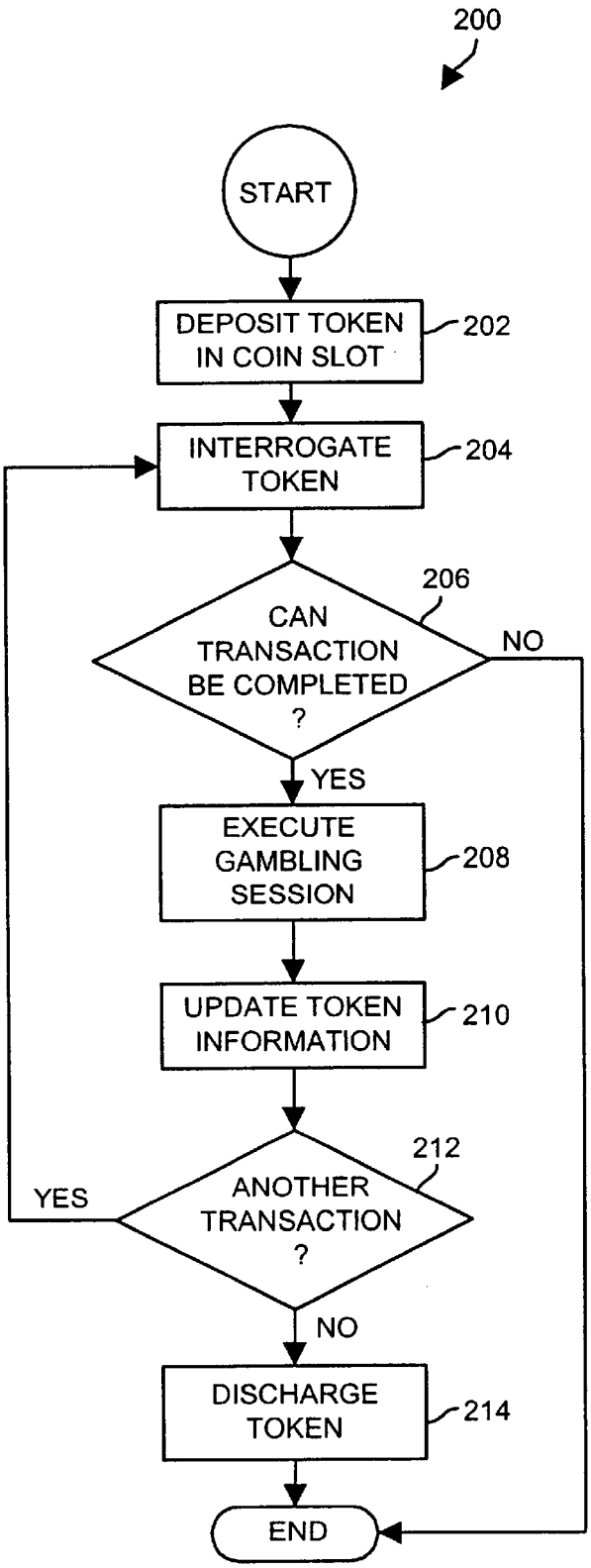
FIG. 5 is an exemplary flow diagram of a method by which a cashless gaming transaction may be conducted using the smart tokens shown in FIGS. 1A, 1B and 3.

FIG. 5 is an exemplary flow diagram 200 of a method by which an electronic cashless gaming transaction may be conducted within the gaming system 100 shown in FIG. 4 using the smart token 10 of FIGS. 1A and 1B or the smart token 50 shown in FIG. 3. In block 202, a player deposits the smart token 10 in the coin slot 120. The token 10 then travels within the gaming device 102 to the reader 130 and, in block 204, the gaming device 102 interrogates the token 10 by transmitting and receiving signals (either conductively via the surface contacts 18 or using electromagnetic signals via the antenna 16) to/from the digital circuit 12. During the interrogation process, the gaming device 102 may request that the current transaction be authorized by verifying that the player is authorized to conduct the requested cashless transaction. For example, the gaming device 102 may request that the player enter a password and/or PIN via the keypad 126 and may send the entered password and/or PIN to the smart token 10, 50. The smart token 10 can then compare the entered password and/or PIN to passwords and/or PINs stored within the memory 32 of the digital circuit 12. The result of the comparison made by the smart token 10 may then be sent to the gaming device 102. Alternatively or additionally, the gaming device 102 may request that the player provide a biometric input via the biometric device 128, which is similarly sent to the smart token 10 and compared to biometric information that is stored within the memory 32 or which is centrally stored within the host 110 to produce a comparison result that is sent to the gaming device 102. The requested biometric input may be a fingerprint, a voice sample, a retinal scan, or any other suitable biometric input providing the desired level of security. Additionally, during the interrogation process, the gaming device 102 may request that the smart token 10 authorize the amount of the requested transaction. In response to a transaction amount authorization request, the smart token 10 may compare the requested transaction amount to one or more account balances stored in the memory 32 of the digital circuit 12. Still further, the smart token 10 may compare the transaction amount to other parameters stored in the memory 32 such as preset transactions limits, which may be predetermined by the authorized user of the smart token 10 or which may be predetermined by some other person or entity during the process of configuring the smart token 10. In any event, the smart token 10 may then generate a yes/no response to the interrogation regarding authorization to proceed with the requested transaction.

In block 206, the gaming device determines whether or not the requested transaction can be completed based on several factors. First, the gaming device 102 may determine whether or not the smart token 10 has authorized the transaction (i.e., has verified the player's identity and authorized the requested transaction amount and account). Next, the gaming device 102 may convey requested transaction information along with player identity information to the system level databus 116 via the local databus 104 and the host 110. In this manner, the gaming system 100 can carry out further security checks and transaction checks using one or more of the system level processing stations 112 and 114. For example, transactions on a given gaming device and/or transactions engaged in by a particular player may be analyzed to determine if cheating is occurring. Also, for example, transactions completed at a given gaming device may be tracked to determine if the gaming device is malfunctioning in some manner. In any event, once the gaming device 102 determines that the requested transaction can be completed, the gaming device 102 enters block 208.

In block 208, the gaming device 102 executes a gambling session. For example, the transaction amount requested in block 204, which may be a dollar amount, may be applied to a temporary session account in the form of game credits. Once the session account has been established, the player may use game credits from the session account to place bets for the gaming activities that take place within the session. Of course, If the player wins a bet, then the gaming device 102 may add game credits to the session account and, if the player loses a bet, game credits may be subtracted from the session account. The player may continue the gambling session until either the available game credits in the session account have reached zero or until the player indicates a desire to end the session.

Once the gambling session is terminated, the gaming device 102 enters block 210 to update the information stored on the smart token 10. For example, any game credits remaining in a session account may be converted to a dollar amount and credited to one or more of the player's monetary accounts stored in the memory 32 of the smart token 10. It should be recognized that by updating the player's monetary accounts at the end of a session, as opposed to after each bet has been played out, the amount of time spent accessing a player's monetary accounts can be minimized.

In block 212, the gaming device 102 determines if the player wants to engage in another transaction (e.g., a gambling session). If the player indicates the desire to complete another transaction, then the gaming device reenters block 204. Otherwise, if the player indicates that his gambling activities at the gaming device 102 are completed, the gaming device 102 enters block 214 and discharges the smart token 10 into the coin tray 122.

In some embodiments, the magnetic stripe reader 124 and keypad 126 may be configured to enable a player to add monetary value to one or more accounts stored within the memory 32 of the smart token 10. For example, a player may receive an indication from the gaming device 102 that the smart token 10 (which is currently being interrogated by the reader 130 within the gaming device 102), has insufficient funds to complete the requested transaction. In response, the player may be able to use a conventional banking/credit card and the magnetic stripe reader 124 to add funds to the smart token 10 in the course of play, without having to leave the gaming device 102, thereby minimizing the interruption of the player's gambling activities.

Generally speaking, the smart token described herein may be used to provide a variety of accounting/player tracking features. For instance, a smart token user may query the token for a complete account history either directly using a keypad and display integral with the token (such as those shown in FIG. 3) or via a keypad and display of an electronic transaction device in which the token is deposited. Additionally, in the case of gaming applications, the token user may query the token to provide a performance history (i.e., the number of wins/losses by game type, by casino, by date, etc.). Further, in some embodiments, the smart token described herein may enable a casino, or any other business entity, to query the smart token for account history and/or performance history. Still further, the smart token described herein may enable a user to transfer information, including monetary value, between tokens.

While the smart token described herein may generally be used to carry a monetary value for use in cashless transactions, other valuable items such as credits for meals, lodging, beverages, merchandise, etc. may alternatively or additionally be stored on the smart token. In some embodiments, for example, a hotel or travel service may store complementary credits for these non-monetary items and/or may provide smart tokens including a pre-loaded predetermined package or group of non-monetary items such as lodging, food, drinks and credits for merchandise. The hotel or travel service may provide such pre-loaded tokens for a fee or, alternatively, may provide tokens including pre-loaded packages having a modest cash value for free as a promotional tool. Of course, the hotel owner or travel service may, if desired, track the manner in which the token user spends pre-loaded credits by collecting transaction information from the various electronic transaction devices in which the user deposits the token.

As can be seen from the above description, the smart token described herein provides several advantages as compared to conventional credit card-shaped smart cards. For example, the authorized holder of the smart token described herein may interact with a display and keypad to quickly determine how much value is stored in one or more accounts associated with the token. Further, the smart token described herein can be configured to predefine and limit how, where, when and by whom value can be extracted from the token. Still further, the coin shape of the smart token described herein facilitates the use of the smart token within a variety of electronic transaction devices, which may be designed to accept both coins and smart tokens via a coin slot opening. Still further, the coin-shaped body of the smart token described herein provides a rugged packaging for conventional smart card technology that cannot be easily bent, cracked or otherwise distorted during use. As a result, the smart token described herein is unlikely to become unusable and/or jam a reader within an electronic transaction device. Still further, the coin-like form of the smart token described herein enables a reader to be mounted deep within the electronic transaction device (because the smart token has sufficient mass to transport itself through the machine) so that the reader is well-protected from potential vandals and thieves. Still further, the smart token described herein has the look and feel of something which has monetary value, thereby providing intuitive visual and tactile feedbacks that enable a user to quickly distinguish the smart token from the plurality of plastic cards, which are typically carried. The smart token may also provide a distinctive audible feedback when, for example, it is ejected into a conventional coin tray mounted on an electronic transaction device.

The smart token described herein may be particularly useful in gaming and vending machine applications because such a smart token may eliminate the need to empty or fill machines with currency. In fact, the smart token may completely eliminate the need for a coin box, which is a tempting target for vandals and thieves. Additionally, the smart token substantially reduces cash handling activities. For example, the smart token may be self-issued at a kiosk and/or may be exchanged for its remaining cash value at a kiosk, thereby eliminating the need for an attendant cashier.

A range of changes and modifications can be made to the preferred embodiment described above. The foregoing detailed description should be regarded as illustrative rather than limiting and the following claims, including all equivalents, are intended to define the scope of the invention.

What is claimed is:

1. A token for use in a cashless transaction involving an electronic device, the token comprising:

a token body having a coin shape;

a digital circuit embedded within the token body;

a memory embedded within the token body and coupled to the digital circuit;

a display that enables a user to access information stored in the memory and display a subset of the information; and an input/output interface embedded within the token body and coupled to the digital circuit that enables the digital circuit to communicate with the electronic device.

2. A token for use in a cashless transaction involving an electronic device, the token comprising:

a token body having a coin shape;

a digital circuit embedded within the token body;

a memory embedded within the token body and coupled to the digital circuit;

a keypad that enables a user to send commands to the digital circuit; and an input/output interface embedded within the token body and coupled to the digital circuit that enables the digital circuit to communicate with the electronic device.

3. A token for use in a cashless transaction involving an electronic device, the token comprising:

a token body having a coin shape;

a digital circuit embedded within the token body;

a memory embedded within the token body and coupled to the digital circuit; and an input/output interface embedded within the token body and coupled to the digital circuit that enables the digital circuit to communicate with the electronic device, wherein the input/output interface includes an antenna embedded within the token body and a plurality of contacts on a surface of the token body.

4. The token of claim 3, wherein the digital circuit is adapted to store biometric information uniquely associated with a user in the memory.

5. The token of claim 3, wherein the digital circuit is adapted to encrypt communications sent to the electronic device.

6. A method of conducting a cashless transaction for use with a coin-shaped token having a memory, a processor, and an input/output interface, each embedded within the coin-shaped token, the method comprising:

using an electronic device to interrogate the coin-shaped token for information stored in the memory;

receiving an input from a user and comparing the input from the user to security information stored in the memory; and updating the information stored in the memory based on the cashless transaction.

7. The method of claim 6, comprising receiving a personal identification number from the user.

8. The method of claim 6, comprising receiving biometric information from the user.

9. The method of claim 6, comprising electrically contacting a surface of the token and sending signals to the input/output interface through the contacted surface.

10. The method of claim 6, comprising transmitting electromagnetic signals to an antenna embedded within the coin-shaped token.

11. A gaming device for use in a cashless gaming transaction system having a coin-shaped token with a memory, a processor, and an input/output interface, each embedded within the coin-shaped token, the gaming device comprising:

a computer readable medium;

a user input device wherein the user input device is capable of receiving an input from a user; and a computer program stored on the computer readable medium and adapted to be executed by the processor, the computer program being adapted to interrogate the coin-shaped token for information stored in the memory, the computer program being adapted to interrogate the coin-shaped token based upon the input from the user, the computer program being adapted to determine whether the cashless transaction can be completed based on the information stored in the memory and based on the input from the user, and the computer program being adapted to update the information stored in the memory based on the cashless transaction.

12. The gaming device of claim 11, wherein the user input device is a keypad which is capable of receiving a personal identification number from the user, and wherein the computer program is further adapted to determine whether the cashless transaction can be completed based on the personal identification number.

13. The gaming device of claim 11, wherein the user input device is a biometric input device which is capable of receiving biometric information from the user, and wherein the computer program is further adapted to determine whether the cashless transaction can be completed based on the biometric information.

14. The gaming device of claim 11, wherein the computer program is further adapted to interrogate the coin-shaped token for information stored in the memory by electrically contacting a surface of the token and sending signals to the token through the contacted surface.

15. The gaming device of claim 11, wherein the computer program is further adapted to interrogate the coin-shaped token for information stored in the memory by transmitting electromagnetic signals to an antenna embedded within the token.

16. A method of conducting a cashless gaming transaction for use with a gaming device and a coin-shaped token having a memory, a processor, and an input/output interface each embedded within the coin-shaped token the coin-shaped token, the method comprising:

inserting the coin-shaped token into the gaming device;

using an electronic device operatively coupled to the gaming device to interrogate the coin-shaped token for information stored in the memory;

initiating a gaming session on the gaming device;

determining a value payout associated with an outcome of said gaming session; and updating the information stored in the memory based on the value payout.

17. The method of claim 16, wherein the gaming device includes a user input device, and wherein the method further comprises receiving an input from a user.

18. The method of claim 17, comprising receiving a personal identification number from the user.

19. The method of claim 17, comprising receiving biometric information from the user.

* * * * *